US009914515B1

(12) United States Patent
Powers

(10) Patent No.: US 9,914,515 B1
(45) Date of Patent: Mar. 13, 2018

(54) BARREL EXTENSION ASSEMBLIES AND METHODS FOR MARINE PROPELLERS

(71) Applicant: Charles S. Powers, Shreveport, LA (US)

(72) Inventor: Charles S. Powers, Shreveport, LA (US)

( * ) Notice: Subject to any disclaimer, the term of this patent is extended or adjusted under 35 U.S.C. 154(b) by 294 days.

(21) Appl. No.: 14/847,115

(22) Filed: Sep. 8, 2015

Related U.S. Application Data

(60) Provisional application No. 62/049,153, filed on Sep. 11, 2014.

(51) Int. Cl.
*B63H 1/14* (2006.01)

(52) U.S. Cl.
CPC ..... *B63H 1/14* (2013.01)

(58) Field of Classification Search
CPC ..... B63H 1/14; B63H 1/20; B63H 1/26
See application file for complete search history.

(56) References Cited

U.S. PATENT DOCUMENTS 3,246,698 A * 4/1966 Kiekhaefer ..... B63H 20/245 416/189
4,212,586 A * 7/1980 Aguiar ..... B63H 1/20 416/93 A
4,276,036 A 6/1981 Nishida et al.

* cited by examiner

*Primary Examiner* — Stephen P Avila
(74) *Attorney, Agent, or Firm* — R. Keith Harrison

(57) ABSTRACT

Barrel extension assemblies for structural modification of a propeller barrel on a marine propeller include a ring housing having a ring housing interior, the ring housing adapted to detachably engage an interior surface of the propeller barrel at a trailing barrel edge for structural modification of the propeller barrel. Barrel extension methods for modifying performance of a marine vessel are also disclosed.

18 Claims, 10 Drawing Sheets

BARREL EXTENSION ASSEMBLIES AND METHODS FOR MARINE PROPELLERS

CROSS-REFERENCE TO RELATED APPLICATIONS

This application claims the benefit of U.S. provisional application No. 62/049,153, filed Sep. 11, 2014 and entitled BARREL EXTENSION ASSEMBLIES AND METHODS FOR MARINE PROPELLERS, which provisional application is hereby incorporated by reference herein in its entirety.

FIELD

Illustrative embodiments of the disclosure generally relate to propellers for marine vessels. More particularly, illustrative embodiments of the disclosure relate to barrel extension assemblies and methods which modify the shape and/or length of a propeller hub or barrel on a marine vessel to achieve various performance characteristics of the marine vessel.

BACKGROUND

The background description provided herein is solely for the purpose of generally presenting the context of the illustrative embodiments of the disclosure. Aspects of the background description are neither expressly nor impliedly admitted as prior art against the claimed subject matter.

Marine vessels such as outboard and stern drive watercraft include at least one engine-driven propeller having an elongated propeller hub or barrel and multiple propeller blades extending from the propeller barrel. Changes in the shape and length of the propeller barrel can create significant changes in performance of the watercraft.

Therefore, barrel extension assemblies and methods which modify the shape and/or length of a propeller barrel on a marine vessel to achieve various performance characteristics of the marine vessel may be desirable for some applications.

SUMMARY

Illustrative embodiments of the disclosure are generally directed to barrel extension assemblies for structural modification of a propeller barrel on a marine propeller. An illustrative embodiment of the assemblies includes a ring housing having a ring housing interior, the ring housing adapted to detachably engage an interior surface of the propeller barrel at a trailing barrel edge for structural modification of the propeller barrel.

Illustrative embodiments of the disclosure are further generally directed to barrel extension methods for modifying the performance of a marine vessel. An illustrative embodiment of the methods includes structurally modifying a propeller barrel on a marine propeller by attaching a ring housing of a barrel extension assembly to the propeller barrel and operating the marine vessel, whereby the barrel extension assembly modifies performance characteristics of the marine vessel.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
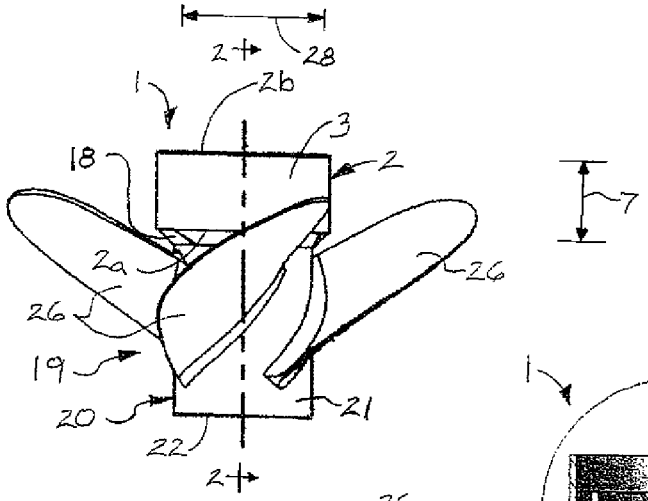
FIG. 1 is a side view of an illustrative parallel-ring embodiment of the barrel extension assemblies, mounted on a marine propeller.
Figure 2:
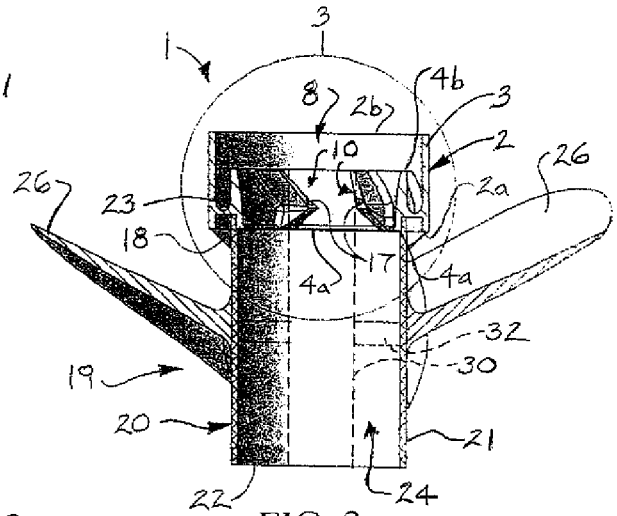
FIG. 2 is a longitudinal sectional view of the marine propeller and mounted barrel extension assembly, taken along section lines 2-2 in FIG. 1.
Figure 3:
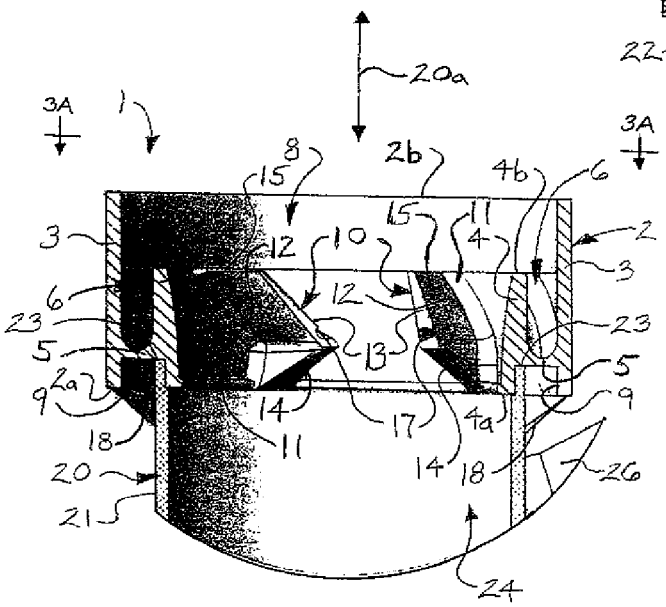
FIG. 3 is an enlarged sectional view, taken along section line 3 in FIG. 2, of the barrel extension assembly.

Referring initially to FIGS. 1-3D of the drawings, an illustrative parallel-ring embodiment of the barrel extension assemblies, hereinafter assembly, is generally indicated by reference numeral 1. As illustrated in FIGS. 1-3 and will be hereinafter described, in typical application, the assembly 1 may be attached to a propeller hub or barrel 20 of a marine propeller 19 to modify the shape and/or length of the propeller barrel 20 and achieve various performance characteristics of a marine vessel (not illustrated) having an engine which drivingly engages the marine propeller 19. The assembly 1 may include a ring housing 2 having a leading ring edge 2*a* and a trailing ring edge 2*b*. As illustrated in FIG. 1, in some embodiments, the ratio of the ring housing length 7 of the ring housing 2 to the greatest propeller barrel diameter 28 of the propeller barrel 20 may be from about 1 to about 1.25. The ring housing 2 may have a generally cylindrical outer ring housing wall 3. As illustrated in FIGS. 2 and 3, a ring housing interior 8 may be formed within the outer ring housing wall 3. A generally cylindrical inner ring housing wall 4 may be disposed in the ring housing interior 8 in generally concentric and spaced-apart relationship to the outer ring housing wall 3. The inner ring housing wall 4 may have a leading wall edge 4*a* and a trailing wall edge 4*b* which may terminate in the ring housing interior 8. A connecting wall portion 5 may connect the inner ring housing wall 4 to the outer ring housing wall 3. An annular wall space 6 may be formed by and between the outer ring housing wall 3 and the inner ring housing wall 4. An annular barrel notch 9 may be provided at the leading ring edge 2*a* between the outer ring housing wall 3 and the inner ring housing wall 4. The barrel notch 9 may be disposed in fluid communication with the wall space 6 through at least one opening (not illustrated) in the connecting wall portion 5.

In some embodiments, a closeable flap door 18 may be provided on the outer ring housing wall 3 of the ring housing 2 at the leading ring edge 2*a*. The flap door 18 may be a deformable material such as plastic, rubber or other elastomeric material. The flap door 18 may be disposed in a closed position illustrated in FIGS. 1-3 and 3C or an opened position illustrated in FIG. 3D for purposes which will be hereinafter described. In the closed position, the flap door 18 may assume a beveled or angled position.

Figure 3A:
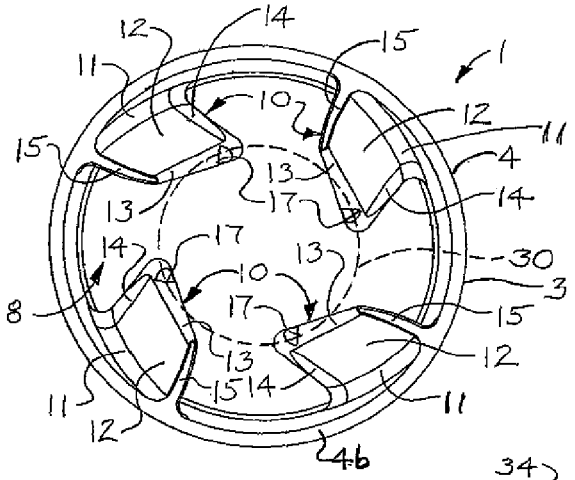
FIG. 3A is a trailing end view of the illustrative barrel extension assembly, mounted to an inner barrel sleeve (illustrated in phantom) in a propeller barrel of the marine propeller.
Figure 3B:
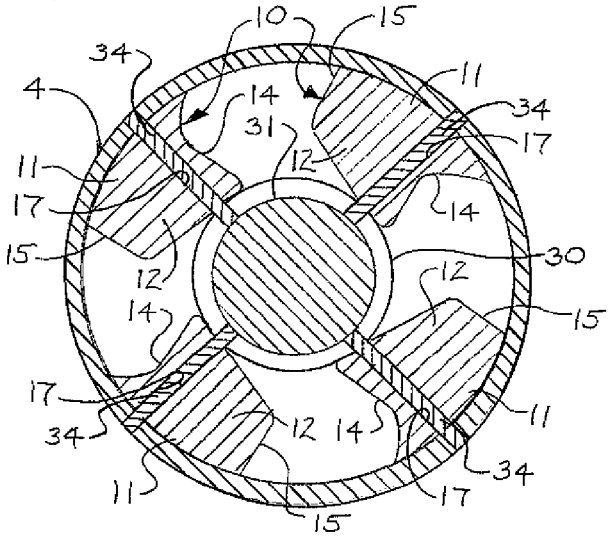
FIG. 3B is a cross-sectional view of the illustrative barrel extension assembly, more particularly illustrating a typical fastener technique for securing the barrel extension assembly to an inner barrel sleeve in the propeller barrel.

As particularly illustrated in FIGS. 3, 3A and 3B, multiple ring vanes 10 may protrude from the inner ring housing wall 4 into the ring housing interior 8 of the ring housing 2. Each ring vane 10 may include a vane base 11 which protrudes from the interior surface of the inner ring housing wall 4 and a vane body 12 which extends from the vane base 11. Each ring vane 10 may traverse the length of the inner ring housing wall 4 from the leading wall edge 4*a* to the trailing wall edge 4*b*. In some embodiments, each ring vane 10 may be oriented toward and at an acute angle to a central axis 20*a* (FIG. 3) of the ring housing 2. In other embodiments, the ring vanes 10 may have a helical or straight orientation within the ring housing interior 8. The vane body 12 may have a leading vane edge 14 which is generally corresponds in position to the leading wall edge 4*a* and a trailing vane edge 15 which generally corresponds in position to the trailing wall edge 4*b* of the inner ring housing wall 4. The vane body 12 may have an inner vane edge 13 which extends between the leading vane edge 14 and the trailing vane edge 15 and is disposed toward the center of the ring housing interior 8. A fastener opening 17 may extend into the inner vane edge 13 of the vane body 12 for purposes which will be hereinafter described.

As illustrated in FIGS. 1-3, 3C and 3D, in typical application, the assembly 1 is mounted on a propeller barrel 20 of a marine propeller 19 for use in propelling a marine vessel (not illustrated) such as an outboard or stem drive watercraft, for example and without limitation, on a body of water. The marine propeller 19 may have a conventional design with an elongated, cylindrical propeller barrel wall 21 including a leading barrel edge 22, a trailing barrel edge 23 and a barrel interior 24 which traverses the propeller barrel 20. Propeller blades 26 extend outwardly from the propeller barrel wall 21 of the propeller barrel 20. An inner barrel sleeve 30 (illustrated in phantom) may be centralized in the barrel interior 24 of the propeller barrel 20 by multiple barrel vanes 32.

The assembly 1 may be mounted on the propeller barrel 20 of the marine propeller 19 by inserting the trailing barrel edge 23 of the propeller barrel wall 21 in the barrel notch 9 in the leading ring edge 2*a* of the ring housing 2 typically until the trailing barrel edge 23 engages the connecting wall portion 5, as illustrated in FIG. 3. The inner ring housing wall 4 may be attached to the propeller barrel wall 21 by one or more internal male protrusions (such as a set screw, spring plunger or internal rib sections or bosses, for example and without limitation) that contact the inner surface of the propeller barrel wall 21 by surface tension, or alternatively, may also use surface tension confined by an internal groove. The internal rib sections or bosses may also act as a housing for the holes that allow the multiple projecting points to be encompassed with enough material to withstand the mechanical loads placed upon them. This may be particularly important in the case of an assembly 1 having a plastic or composite ring housing 2, in which the length of the ring housing 2 may need to be sufficient to spread the mechanical load over a greater amount of the weaker material (as opposed to a metallic ring, where the thread length can be very short, typically ⅛ inch to ¼ inch). The annular wall space 6 and the annular barrel notch 9 in the ring housing 2 may be disposed exterior to the outer diameter or circumference of the propeller barrel wall 21.

As illustrated in FIG. 3B, in some embodiments, an exhaust ring fastener 34 may protrude from the fastener opening 17 in each ring vane 10. Each exhaust ring fastener 34 may insert into a circumferential fastener groove 31 in the inner barrel sleeve 30 of the propeller barrel 20 to secure the ring housing 2 of the assembly 1 on the propeller barrel 20.

In operation of the watercraft on which the marine propeller 19 is installed, the flared shape of the ring housing 2 of the assembly 1 increases stem lift on the watercraft. The flared ring housing 2 may additionally create a pressure wave which prevents the propeller blades 26 from aerating or ventilating due to migration of exhaust gas passing through the barrel interior 24 of the propeller barrel 20 that may otherwise exit the propeller barrel 20 and then be drawn onto the face of the propeller blades 26. This may prevent the engine of the marine vessel from racing as may otherwise occur in the event that the marine propeller 19 loses its thrust due to the aeration. This may be particularly important in the planing of a heavy marine vessel or in sharp cornering maneuvers.

Figure 3C:
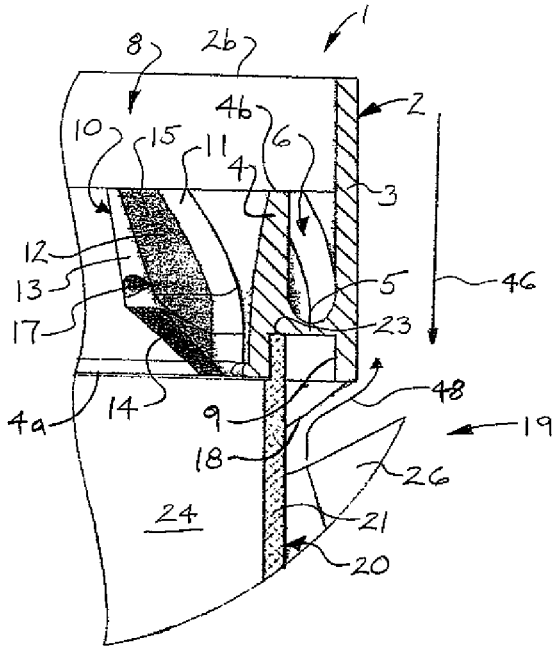
FIG. 3C is an enlarged sectional view of a portion of the barrel extension assembly, more particularly illustrating typical flow of water and exhaust gas in forward operation of the marine vessel.
Figure 3D:
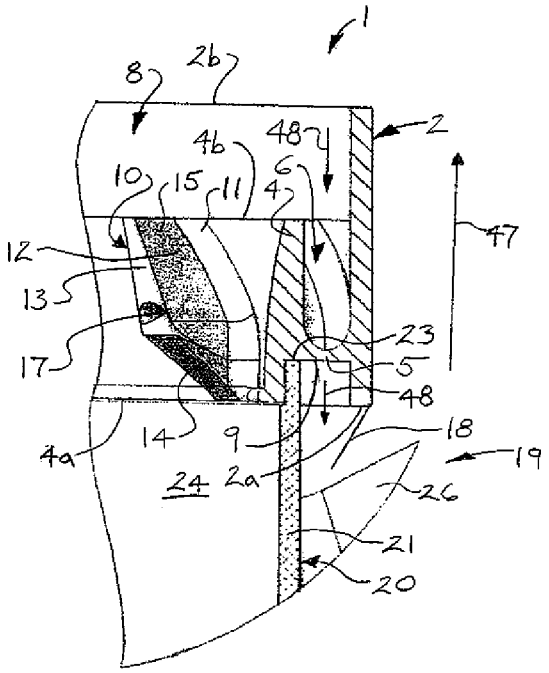
FIG. 3D is an enlarged sectional view of a portion of the barrel extension assembly, more particularly illustrating typical flow of water and exhaust gas in rearward operation of the marine vessel.
Figure 4:
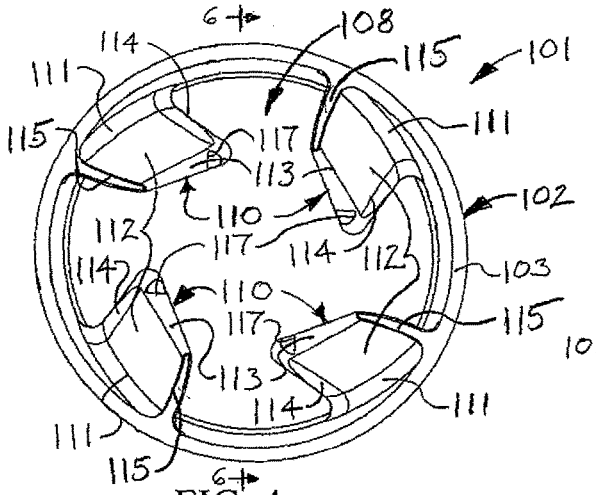
FIG. 4 is a trailing end view of an illustrative embodiment of an alternative, single-ring embodiment of the barrel extension assemblies.
Figure 5:
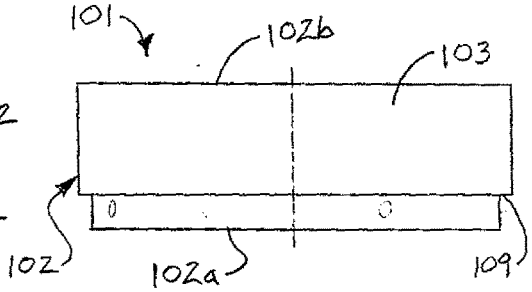
FIG. 5 is a side view of the illustrative barrel extension assembly illustrated in FIG. 4.
Figure 6:
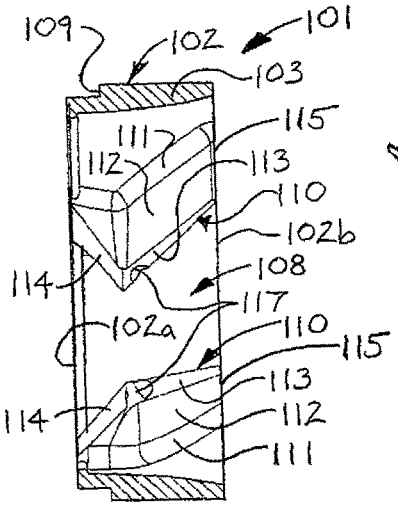
FIG. 6 is a cross-sectional view of the illustrative barrel extension assembly illustrated in FIG. 4, taken along section lines 6-6.

As illustrated in FIG. 3C, in forward operation 46 of the marine vessel, the marine propeller 19 may normally bypass exhaust gas 48 from the engine of the vessel. As illustrated in FIG. 3D, in reverse operation 47 of the marine vessel, the parallel ring construction of the ring housing 2 may allow the exhaust gas 48 to be channeled forwardly through the wall space 6 and the barrel notch 9 between the outer ring housing wall 3 and the inner ring housing wall 4, thereby preventing the exhaust gas 48 from being drawn into the primary working surface of the propeller blades 26. Accordingly, the flexible or angular spring-loaded flap door 18 may be closed and direct water flow and exhaust gas 48 over the ring housing 2 in forward operation 46 of the marine vessel, as illustrated in FIG. 3C, but may open to facilitate flow of water and exhaust gas 48 through the ring housing 2 in reverse operation 47 of the marine vessel, as illustrated in FIG. 3D. The internal ring vanes 10 in the ring housing interior 8 of the ring housing 2 may aid in removing exhaust gas 48 from the engine of the marine vessel at a more rapid rate than would otherwise be possible. In some embodiments, the ring housing 2 may additionally or alternatively be fitted with external helical, angled, or straight vanes (not illustrated) that aid in changing the flow characteristics of the water to avoid cavitation, change vortex patterns and/or produce less drag. The assembly 1 can be selectively detached from the propeller barrel 20 by reversing the steps described above.

Figure 7:
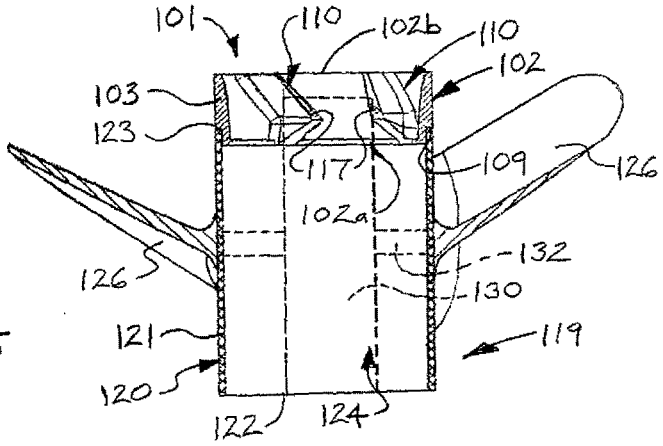
FIG. 7 is a longitudinal sectional view of the illustrative barrel extension assembly illustrated in FIG. 4, mounted on a marine propeller.
Figure 8:
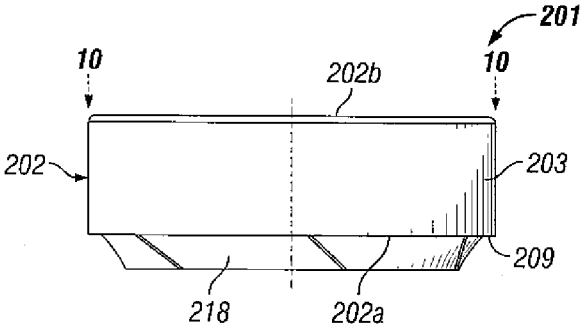
FIG. 8 is a side view of an illustrative alternative parallel-ring embodiment of the barrel extension assembly.
Figure 9:
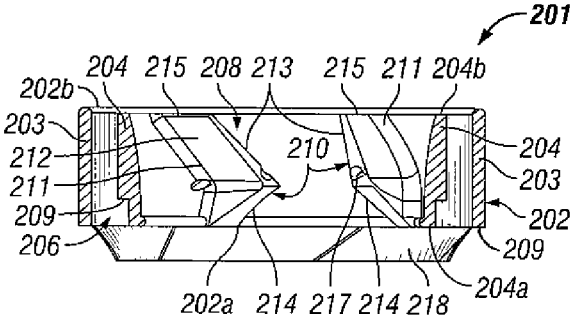
FIG. 9 is a cross-sectional view of the illustrative barrel extension assembly illustrated in FIG. 8.
Figure 10:
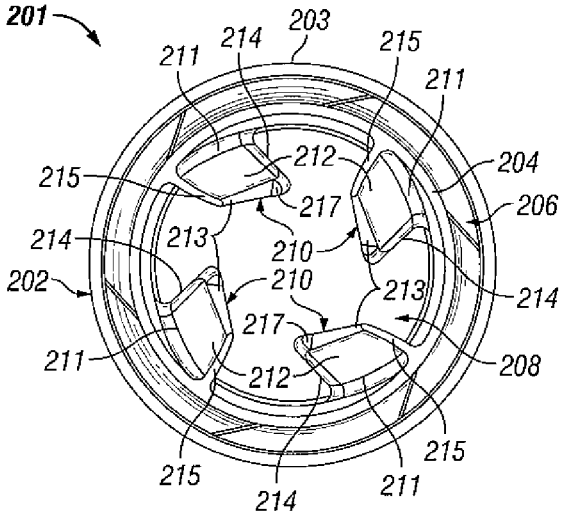
FIG. 10 is a trailing end view of the illustrative barrel extension assembly illustrated in FIG. 8, taken along viewing lines 10-10.
Figure 11:
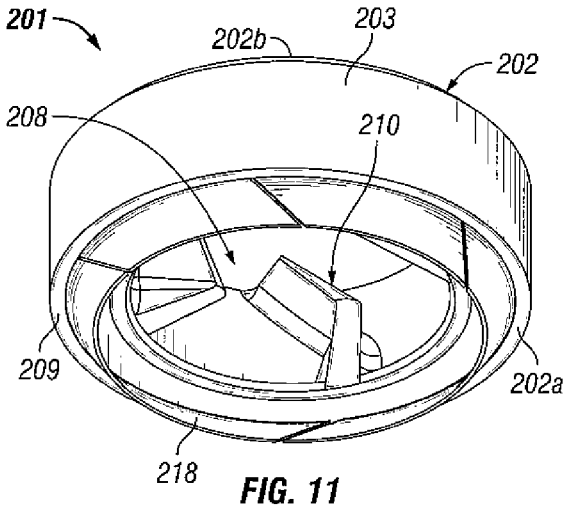
FIG. 11 is a leading end perspective view of the illustrative barrel extension assembly illustrated in FIG. 8.
Figure 12:
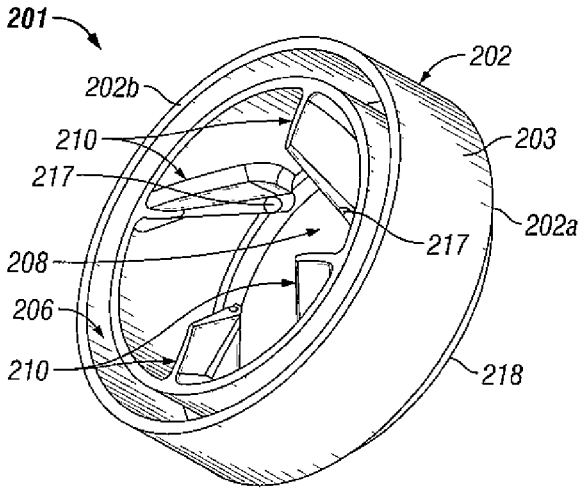
FIG. 12 is a trailing end perspective view of the illustrative barrel extension assembly illustrated in FIG. 8.

Referring next to FIGS. 4-7 of the drawings, an alternative, illustrative single-ring embodiment of the barrel extension assemblies is generally indicated by reference numeral 101. In the assembly 101, elements which are analogous to the respective elements of the assembly 1 that was heretofore described with respect to FIGS. 1-3D are designated by the same numeral in the 101-199 series in FIGS. 4-7. The ring housing 102 of the assembly 101 may include the outer ring housing wall 103. The ring vanes 110 may extend from the interior surface of the outer ring housing wall 103. An annular barrel notch 109 may be provided in the exterior surface of the outer ring housing wall 103 at the leading ring edge 102*a* of the ring housing 102. Accordingly, in mounting of the assembly 101 on the propeller barrel 120 of the marine propeller 119, the trailing barrel edge 123 of the propeller barrel 120 may insert into the barrel notch 109. The ring housing 102 may be secured to the propeller barrel 120 as was heretofore described with respect to the assembly 1. As illustrated in FIG. 7, the exterior surface of the ring housing 102 may be flush with the exterior surface of the propeller barrel wall 121 of the propeller barrel 120.

In operation of the marine vessel, the internal ring vanes 110 in the ring housing interior 108 of the ring housing 102 may aid in removing exhaust gas from the engine of the marine vessel at a more rapid rate than would otherwise be possible. In some embodiments, the ring housing 102 may additionally or alternatively be fitted with external helical, angled, or straight vanes (not illustrated) that aid in changing the flow characteristics of the water to avoid cavitation, change vortex patterns and/or produce less drag.

Figure 13:
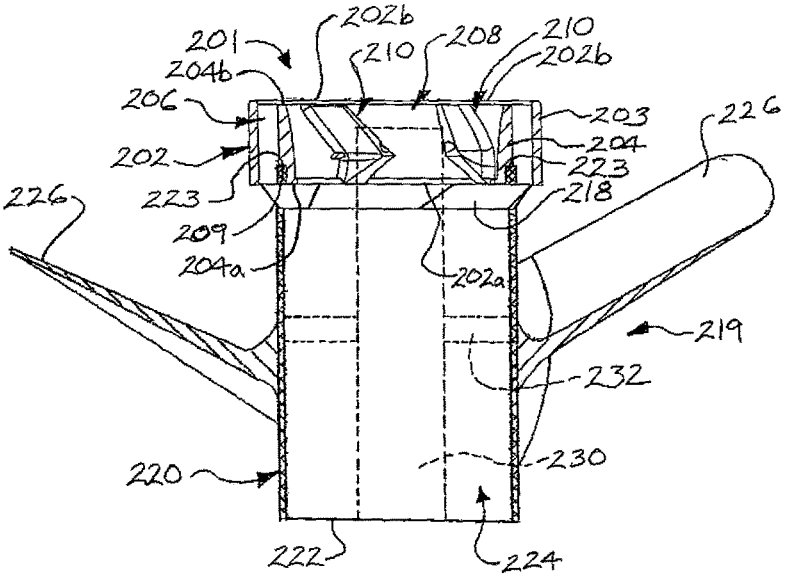
FIG. 13 is a longitudinal sectional view of the barrel extension assembly illustrated in FIG. 8, mounted on a marine propeller.
Figure 14:
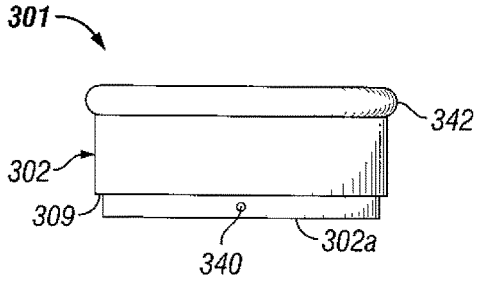
FIG. 14 is a side view of an illustrative safety flare embodiment of the barrel extension assemblies.
Figure 15:
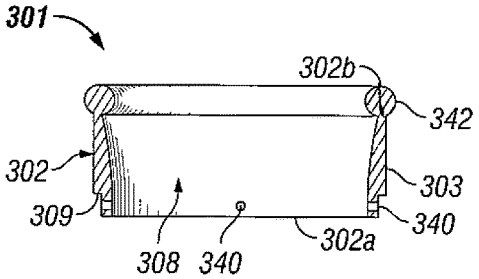
FIG. 15 is a cross-sectional view of the illustrative safety flare barrel extension assembly illustrated in FIG. 14.
Figure 16:
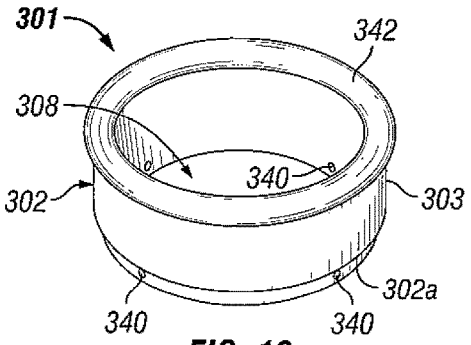
FIG. 16 is a trailing end perspective view of the illustrative safety flare barrel extension assembly illustrated in FIG. 14.
Figure 17:
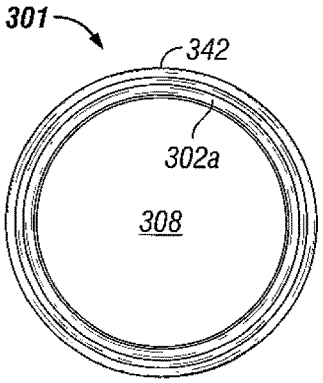
FIG. 17 is a leading end view of the illustrative safety flare barrel extension assembly illustrated in FIG. 14.
Figure 18:
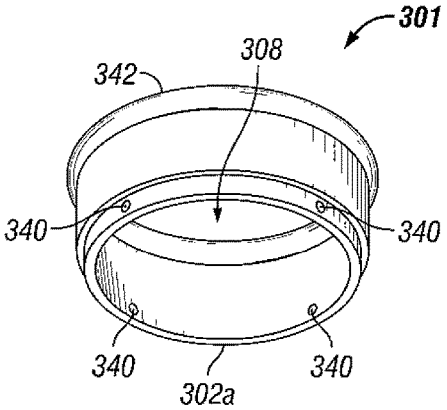
FIG. 18 is a leading end perspective view of the illustrative safety flare barrel extension assembly illustrated in FIG. 14.

Referring next to FIGS. 8-13 of the drawings, an alternative illustrative parallel-ring embodiment of the barrel extension assembly is generally indicated by reference numeral 201. In the assembly 201, elements which are analogous to the respective elements of the assembly 1 that was heretofore described with respect to FIGS. 1-3D are designated by the same numeral in the 201-299 series in FIGS. 8-13. In the assembly 201, an annular barrel notch 209 (FIG. 9) may be provided in the leading wall edge 204*a* of the inner ring housing wall 204. In attachment of the assembly 201 to the marine propeller 219, which may be as was heretofore described with respect to the assembly 1, the barrel notch 209 seats against the trailing barrel edge 223 of the propeller barrel 220, as illustrated in FIG. 13.

The marine propeller 219 (FIG. 13) may normally bypass exhaust gas 48 in forward operation 46 of the marine vessel, as was heretofore described with respect to FIG. 3C. In reverse operation 47 of the marine vessel, as was heretofore described with respect to FIG. 3D, the parallel ring construction of the ring housing 202 may allow the exhaust gas 48 to be channeled through the wall space 206 between the outer ring housing wall 203 and the inner ring housing wall 204, thereby preventing the exhaust gas 48 from being drawn into the primary working surface of the propeller blades 226. Accordingly, the flexible or angular spring-loaded flap door 218 may direct water flow and exhaust gas 48 over the ring housing 202 in forward operation 46 (FIG. 3C) of the marine vessel but may open to facilitate flow of water and exhaust gas 48 through the ring housing 202 in reverse operation 47 (FIG. 3D) of the marine vessel. The internal ring vanes 210 in the ring housing interior 208 of the ring housing 202 may aid in removing exhaust gas from the engine of the marine vessel at a more rapid rate than would otherwise be possible. In some embodiments, the ring housing 202 may additionally or alternatively be fitted with external helical, angled, or straight vanes (not illustrated) that aid in changing the flow characteristics of the water to avoid cavitation, change vortex patterns and/or produce less drag.

Figure 19:
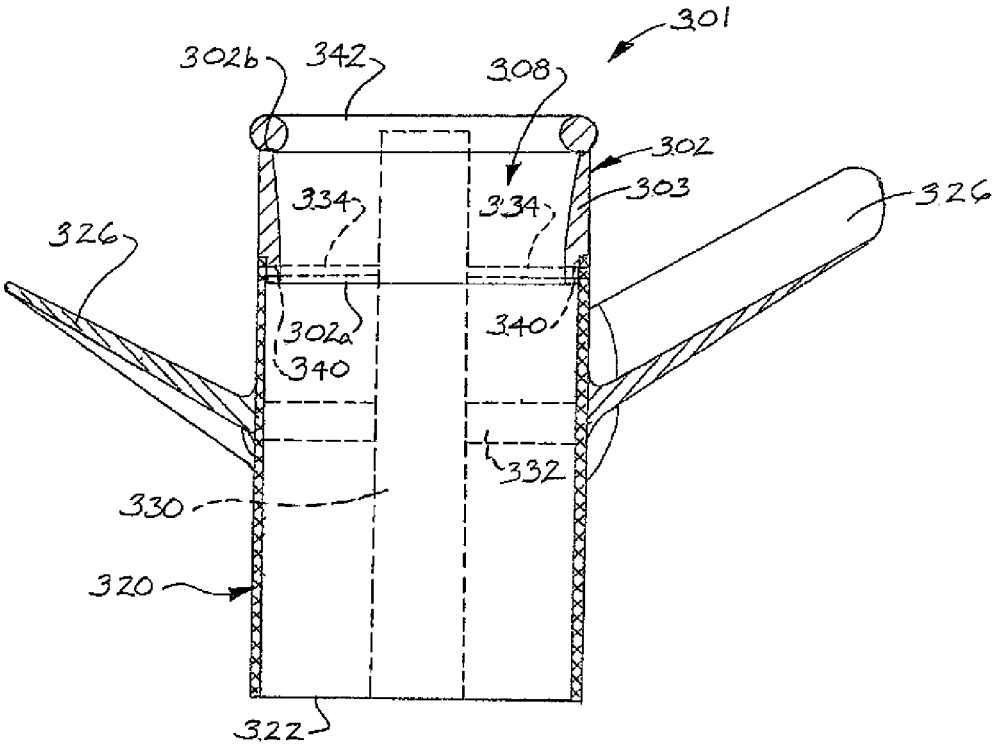
FIG. 19 is a longitudinal sectional view of the safety flare barrel extension assembly, mounted on a marine propeller.

Referring next to FIGS. 14-18 of the drawings, an illustrative safety flare embodiment of the barrel extension assemblies is generally indicated by reference numeral 301. In the assembly 301, elements which are analogous to the respective elements of the assembly 1 that was heretofore described with respect to FIGS. 1-3D are designated by the same numeral in the 301-399 series in FIGS. 14-18. Fastener openings 340 may extend through the outer ring housing wall 303 of the ring housing 302 to facilitate attachment of the ring housing 302 to the propeller barrel 220 using exhaust ring fasteners 334 (FIG. 19). The trailing ring edge 302*b* of the ring housing 302 may be rounded to create an effective deflection surface which deflects persons or marine life away from direct contact with the propeller blades 326 of the marine propeller 319 during operation of the marine vessel. The rounded trailing ring edge 302*b* may additionally minimize the cutting potential or danger of the ring housing 302 to persons or marine life. In some embodiments, an annular safety lip 342 which may include an elastomeric material such as plastic or rubber may be provided on the trailing ring edge 302*b*. It will be appreciated by those skilled in the art that the rounded trailing ring edge 302*b* of the ring housing 302 may be implemented on the parallel-ring assembly 1 of FIGS. 1-3D, the parallel-ring assembly 201 of FIGS. 8-13 or the single-ring assembly 101 of FIGS. 4-7.

It will be appreciated by those skilled in the art that the barrel extension assemblies of the disclosure enable the angle of attack of a propeller barrel on a marine propeller to generate various effects of a watercraft on a body of water. The wide varieties of effects that can be produced with the barrel extension assemblies of the disclosure allow a high degree of customization of marine propellers that may not otherwise be possible. The barrel extension assemblies may be accomplished both quickly and inexpensively in a field environment.

Figure 20:
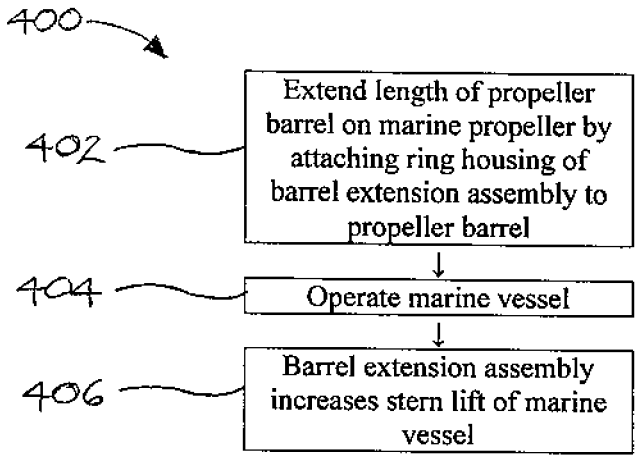
FIG. 20 is a flow diagram of an illustrative embodiment of a barrel extension method which modifies the performance of a marine vessel.

Referring next to FIG. 20 of the drawings, a flow diagram 400 of an illustrative embodiment of a barrel extension method is illustrated. The method may be implemented to modify the performance of a marine vessel. At block 402, the length of a propeller barrel on a marine propeller is extended by attaching a ring housing of a barrel extension assembly to the propeller barrel. At block 404, the marine vessel is operated. At block 406, the barrel extension assembly increases stern lift of the marine vessel.

While illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A barrel extension assembly for structural modification of a propeller barrel on a marine propeller, comprising:

a ring housing having a ring housing interior, the ring housing adapted to detachably engage the propeller barrel at a trailing barrel edge for structural modification of the propeller barrel, the ring housing having a leading ring edge and a trailing ring edge, the trailing ring edge of the ring housing adapted to detachably engage the propeller barrel at the trailing barrel edge; and a plurality of ring vanes in the ring housing interior of the ring housing, each of the plurality of ring vanes having a leading vane edge at the leading ring edge of the ring housing.

2. The barrel extension assembly of claim 1 wherein each of the plurality of ring vanes is oriented toward and at an acute angle to a central axis of the ring housing.

3. The barrel extension assembly of claim 1 wherein the ring housing comprises an outer ring housing wall, an inner ring housing wall and a wall space between the inner ring housing wall and the outer ring housing wall.

4. A barrel extension assembly for structural modification of a propeller barrel on a marine propeller, comprising:

a ring housing having a ring housing interior, the ring housing adapted to detachably engage the propeller barrel at a trailing barrel edge for structural modification of the propeller barrel;

wherein the ring housing comprises an outer ring housing wall, an inner ring housing wall and a wall space between the inner ring housing wall and the outer ring housing wall;

a plurality of ring vanes in the ring housing interior of the ring housing; and a flap door carried by the outer ring housing wall, the flap door configurable between a first position sealing the wall space and a second position exposing the wall space.

5. The barrel extension assembly of claim 3 wherein the inner ring housing wall has a leading wall edge and a trailing wall edge, and each of the plurality of ring vanes traverses the inner ring housing wall from the leading wall edge to the trailing wall edge.

6. A barrel extension assembly for structural modification of a propeller barrel on a marine propeller, comprising:

a ring housing having a ring housing interior, the ring housing adapted to detachably engage the propeller barrel at a trailing barrel edge for structural modification of the propeller barrel;

wherein the ring housing comprises an outer ring housing wall, an inner ring housing wall and a wall space between the inner ring housing wall and the outer ring housing wall;

a plurality of ring vanes in the ring housing interior of the ring housing; and wherein each of the plurality of ring vanes comprises a vane base protruding from an interior surface of the inner ring housing wall and a vane body extending from the vane base.

7. The barrel extension assembly of claim 1 wherein the ring housing comprises a leading ring edge and a trailing ring edge, and further comprising a safety lip on the trailing ring edge.

8. A barrel extension assembly for structural modification of a propeller barrel on a marine propeller, comprising:

a ring housing having an outer ring housing wall, a ring housing interior in the outer ring housing wall, an inner ring housing wall in the ring housing interior and a wall space between the inner ring housing wall and the outer ring housing wall, the ring housing adapted to detachably engage the propeller barrel at a trailing barrel edge for structural modification of the propeller barrel; and a plurality of ring vanes protruding from the inner ring housing wall into the ring housing interior, each of the plurality of ring vanes oriented toward and at an acute angle to a central axis of the ring housing.

9. The barrel extension assembly of claim 8 further comprising a flap door carried by the outer ring housing wall, the flap door configurable between a first position sealing the wall space and a second position exposing the wall space.

10. The barrel extension assembly of claim 8 wherein the inner ring housing wall has a leading wall edge and a trailing wall edge, and each of the plurality of ring vanes traverses the inner ring housing wall from the leading wall edge to the trailing wall edge.

11. The barrel extension assembly of claim 10 wherein each of the plurality of ring vanes comprises a vane base protruding from an interior surface of the inner ring housing wall and a vane body extending from the vane base.

12. The barrel extension assembly of claim 11 wherein the vane body comprises a leading vane edge generally corresponding in position to the leading wall edge of the inner ring housing wall, a trailing vane edge generally corresponding in position to the trailing wall edge of the inner ring housing wall, and an inner vane edge extending between the leading vane edge and the trailing vane edge and disposed toward a center of the ring housing interior.

13. The barrel extension assembly of claim 10 further comprising a barrel notch in the leading wall edge, the barrel notch configured to accommodate the trailing barrel edge on the propeller barrel.

14. The barrel extension assembly of claim 8 further comprising a fastener opening in each of the plurality of ring vanes and an exhaust ring fastener protruding from the fastener opening, and wherein the exhaust ring fastener is configured to insert into a circumferential fastener groove in the propeller barrel to secure the ring housing on the propeller barrel.

15. A method of modifying performance of a marine vessel, comprising:

structurally modifying a propeller barrel on a marine propeller by attaching a ring housing of a barrel extension assembly to the propeller barrel the ring housing having a ring housing interior, a leading ring edge and a trailing ring edge, the leading ring edge of the ring housing adapted to detachably engage the propeller barrel at a trailing barrel edge and a plurality of ring vanes in the ring housing interior of the ring housing, each of the plurality of ring vanes having a leading vane edge at the leading ring edge of the ring housing; and operating the marine vessel, whereby the barrel extension assembly modifies performance characteristics of the marine vessel.

16. A method of modifying performance of a marine vessel, comprising:

structurally modifying a propeller barrel on a marine propeller by attaching a ring housing of a barrel extension assembly to the propeller barrel; and operating the marine vessel, whereby the barrel extension assembly modifies performance characteristics of the marine vessel;

wherein attaching a ring housing of a barrel extension assembly to the propeller barrel comprises attaching a ring housing having a ring housing interior and a plurality of ring vanes in the ring housing interior to the propeller barrel; and wherein attaching a ring housing to the propeller barrel comprises attaching a ring housing having an outer ring housing wall, an inner ring housing wall and a wall space between the inner ring housing wall and the outer ring housing wall to the propeller barrel, with the plurality of ring vanes extending from the inner ring housing wall.

17. A method of modifying performance of a marine vessel, comprising:

structurally modifying a propeller barrel on a marine propeller by attaching a ring housing of a barrel extension assembly to the propeller barrel; and operating the marine vessel whereby the barrel extension assembly modifies performance characteristics of the marine vessel;

wherein attaching a ring housing of a barrel extension assembly to the propeller barrel comprises attaching a ring housing having a ring housing interior and a plurality of ring vanes in the ring housing interior to the propeller barrel;

wherein attaching a ring housing to the propeller barrel comprises attaching a ring housing having an outer ring housing wall, an inner ring housing wall and a wall space between the inner ring housing wall and the outer ring housing wall to the propeller barrel, with the plurality of ring vanes extending from the inner ring housing wall; and wherein attaching a ring housing to the propeller barrel comprises attaching a ring housing having a flap door carried by the outer ring housing wall, the flap door configurable between a first position sealing the wall space and a second position exposing the wall space.

18. The method of claim 15 wherein attaching a ring housing of a barrel extension assembly to the propeller barrel comprises attaching a ring housing comprising a safety lip on the trailing ring edge to the propeller barrel.

* * * * *